United States Patent [19]

Fowler et al.

[11] 4,069,916

[45] Jan. 24, 1978

[54] TAPE FOR HOLDING ELECTRONIC ARTICLES

[75] Inventors: William H. Fowler, Allentown; David P. Ludwig, Whitehall, both of Pa.

[73] Assignee: Western Electric Co., Inc., New York, N.Y.

[21] Appl. No.: 691,798

[22] Filed: June 1, 1976

[51] Int. Cl.[2] ..... B65D 85/30

[52] U.S. Cl. ..... 206/330; 206/389; 428/138

[58] Field of Search ..... 428/138; 206/328, 329, 206/330, 332, 515, 518, 820, 389; 229/2.5

[56] References Cited

U.S. PATENT DOCUMENTS

| | | | |
|---|---|---|---|
| 2,776,772 | 1/1957 | Itoda | 229/2.5 |
| 3,465,874 | 9/1969 | Hugle et al. | 206/56 |
| 3,608,711 | 9/1971 | Wiesler et al. | 206/56 |
| 3,634,930 | 1/1972 | Cranston | 29/574 |
| 3,640,444 | 2/1972 | Ludwig | 228/4 |
| 3,650,430 | 3/1972 | Siegmar et al. | 206/329 |
| 3,655,177 | 4/1972 | Coucoulas | 269/1 |
| 3,661,253 | 5/1972 | Cronkhite | 206/332 |
| 3,695,414 | 10/1972 | Wiesler et al. | 198/108 |
| 3,835,992 | 9/1974 | Adams | 206/460 |
| 3,858,721 | 1/1975 | Boyer et al. | 206/820 |

*Primary Examiner*—Marion E. McCamish
*Assistant Examiner*—Alexander S. Thomas
*Attorney, Agent, or Firm*—W. O. Schellin

[57] ABSTRACT

Electronic articles, such as beam-lead semiconductor chips are temporarily held on a tape to retain them in a predetermined order to facilitate handling them and bonding them to a substrate. The tape has a plurality of evenly spaced pedestals in one face thereof. The chips are mounted to the pedestals. Edge lugs extend from the other face of the tape. As the tape is wound onto a reel with chips mounted to the pedestals, the edge lugs on each portion of tape separate such portion from chips mounted on an adjacent layer of the tape. This prevents such portion of the tape, as it is wound onto the reel, from contacting and thereby damaging the chips.

1 Claim, 7 Drawing Figures

FIG.-1
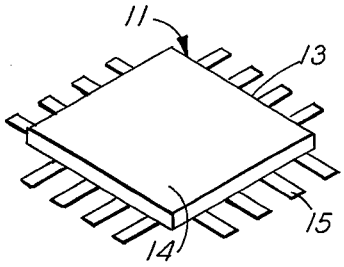
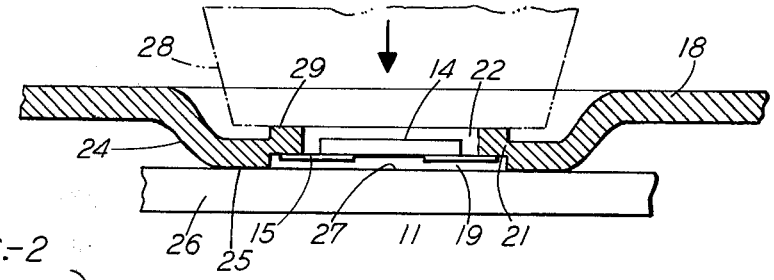
FIG.-2
(PRIOR ART)
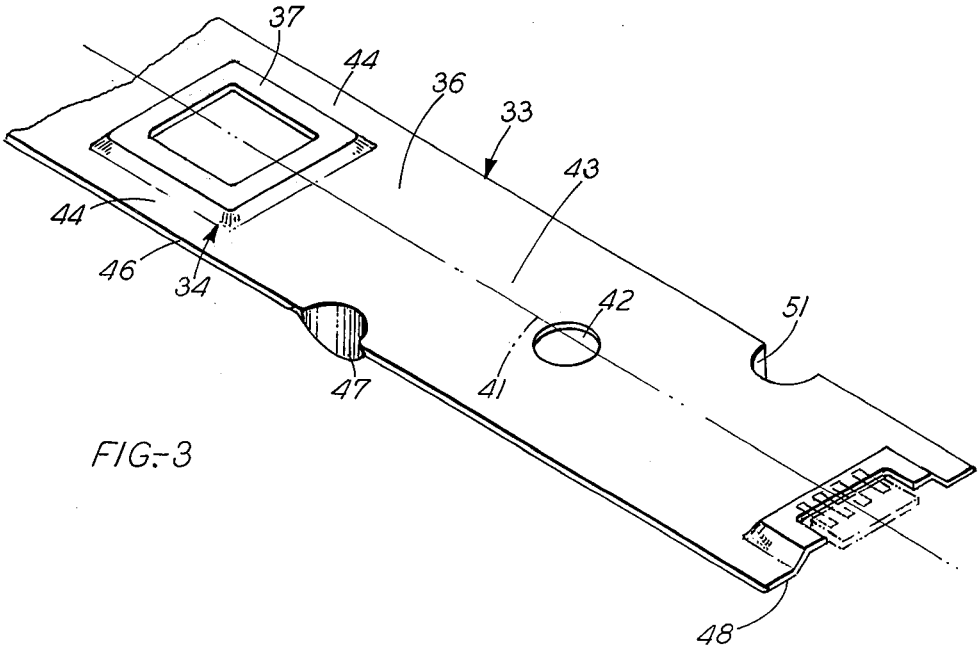
FIG.-3

TAPE FOR HOLDING ELECTRONIC ARTICLES

BACKGROUND OF THE INVENTION

1. Field of the Invention

This invention relates to handling small articles, such as, for example, electronic component chips. More particularly, the invention relates to a tape for temporarily holding the chips. Mounted to the tape, the chips are dispensed to a processing location, such as a bonder. At the bonder the tape is indexed past a bond station where the chips are bonded, in sequence, to sites on a substrate. The particular embodiment of the invention is described with respect to a compliant bonding tape which is adapted to temporarily retain beam-lead semiconductor chips. But, as can be seen from the detailed description, the invention lends itself in a broader sense to handling other small articles as well.

2. Description of the Prior Art

In the semiconductor industry, small semiconductor chips are often bonded to substrates, and conductive elements are interconnected to leads extending from the substrates. U.S. Pat. No. 3,533,155 to A. Coucoulas describes a process of compliantly bonding beam-lead chips to substrates. In U.S. Pat. No. 3,640,444 to D. P. Ludwig, a compliant tape is disclosed which is interposed between the chip and a bonding tool or thermode during bonding. U.S. Pat. No. 3,858,721 to Boyer et al. discloses a further advance in the art wherein the compliant tape is used as a means for temporarily holding the chips to be bonded on the tape. The disclosed tape has periodic depressions of a size which permit beam leads of the chips to rest in such depressions while the body of each of the chips becomes located in a central aperture through each of the depressions. In the process of transferring the chips from the tape to bond sites on respective substrates, the thermode bears against the side of the tape opposite each depression to force the beam leads against the substrate, whereby the chip becomes bonded to the substrate. The material of the tape in the area of the depressions serves as the compliant member between the thermode and the beam leads.

Another advance of the prior art is depicted in FIG. 2 hereof. There, a dual embossment raises each depression from the plane of the tape so that only a small area about the depression actually comes into contact with the substrate to which the chip is to be bonded.

An area of concern in using tapes as temporary packages for beam-lead chips in accordance with the prior art has been the forming of the described embossments and depressions or nesting embossments for the chips in the tape. To ultimately form bonds with a uniform compressive force it is desirable to actually shear the compliant material about the periphery of the nesting embossment with a uniformly repetitive shear force requirement. The depth to which the embossment has to be pushed to establish such a complete shear varies with the material. Therefore, a particular die for embossing the tape is designed for a particular alloy and temper of compliant material.

It has also been observed that when the chips are handled in and then bonded in a transfer from the prior art tape packages, sheared embossments tend to separate from the tape and remain on the substrates with the bonded chips. While such remaining embossments are easily detected and removed, removing them nevertheless involves an additional operation which is desirably eliminated.

SUMMARY OF THE INVENTION

It is, therefore, an object of the invention to provide a new and improved tape for holding electronic articles.

It is another object of the invention to simplify the forming of tapes, particularly of compliant tapes, for holding electronic articles, such as beam-lead chips.

It is still another object of the invention to improve handling of semiconductor chips, including beam-lead semiconductor chips.

In accordance with the invention, a tape for retaining articles includes at least one longitudinal zone on a major surface of the tape for mounting the articles, and lugs extending from the other major surface of the tape in areas laterally offset from the zone. The lugs have a predetermined height greater than that of the articles, whereby an overlying layer of the tape is held out of contact with the articles mounted to the tape.

BRIEF DESCRIPTION OF THE DRAWING

Other advantages and features of the present invention will be more readily understood from the following detailed description, particularly when read in conjunction with the appended drawing wherein:

FIG. 1 is an enlarged, pictorial view of a typical beam-lead semiconductor chip intended to be mounted on and transferred from a tape in accordance with the present invention;

FIG. 2 is an enlarged section of a typical dual embossed tape representative of the prior art;

FIG. 3 is a pictorial view of a portion of a tape which is an embodiment of the present invention;

DETAILED DESCRIPTION

Figure 4:
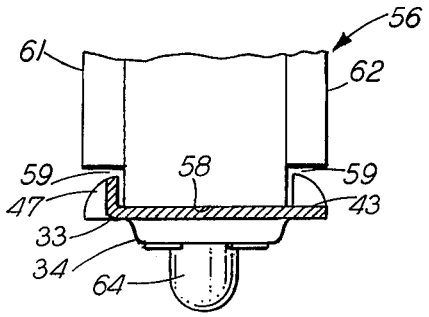
FIG. 4 shows a cross section of the tape of FIG. 3 in relationship to a drive wheel for advancing the tape during handling operations.

FIG. 1 shows a beam-lead semiconductor device, designated generally by the numeral 11, as a typical article of manufacture that can be handled and processed in accordance with the present invention. The present invention is described herein with reference to handling an article such as the semiconductor chip 11. Semiconductor chips, such as the chip 11, are manufactured in various sizes which typically range from 0.01 inch to in excess of 0.10 inch measured along an edge 13. The typical chip 11 has a body 14 of substantially square configuration and beam leads 15 extending from each of the edges 13 of the body 14.

FIG. 2 shows a cross section through a portion of a compliant tape 18 which has been used in the past to temporarily hold chips 11 in a depression or cavity 19 formed by an embossment 21 which provides a recess for retaining the beam leads 15. An aperture 22 holds the body 14 of the chip 11. The dual embossed tape 18 shown in FIG. 2 provides the cavity 19 as well as a pedestal 24 about the cavity 19 in accordance with the prior art. A top surface 25 of the pedestal 24 is substantially the only portion of the tape which contacts a substrate 26 when the chip 11 is positioned opposite a bond site 27 to bond the chip 11 thereto. A thermode 28 is then brought into contact with the innermost embossed material 29 about the aperture 22. As the thermode 28 pushes the material 29 in a direction indicated by the arrow, the beams 15 of the chip 11 are urged into contact with the substrate and the combined thermal and compressive forces transmitted through the material of the tape compliantly bond the leads 15 to the substrate. As already briefly discussed with respect to the prior art, the energy required to force the material 29 through the thickness of the tape 18 toward the substrate 26 to compliantly bond the leads 15 to the substrate depends on the depth of the embossment 21 and of the type and the temper of the material of the tape 18. Consequently, in order to control precisely the bonding energy needed for bonding the leads 15, it becomes highly desirable to minimize any variations that may be introduced by deforming the compliant material 29.

In FIG. 3 there is shown a tape 33 which minimizes the difficulties experienced with the tape 18 of the prior art, and which is formed in accordance with the present invention.

Similar to the prior art tape 18, the material of the tape 33 may be aluminum. However, a silver bearing copper, referred to as CDA 155, is preferred. The choice of or preference for a particular material is not considered essential relative to the present invention. Changes in the material of the tape may be made, for instance, when it is intended to use the tape 33 in a temperature environment which does not extend into temperature ranges of thermocompression bonds of gold beam leads. Changes to plastic material for the tape 33 could also be contemplated, for instance, when the tape is only to be used as a temporary holder for small articles. The tape 33 has periodically spaced pedestals 34 which extend from one major surface or side 36 of the tape 33. Articles to be compliantly bonded using the tape 33 can be mounted to a planar mounting surface 37 on the pedestal 34. In the embodiment of FIG. 3, the pedestals 34 are alternated along a longitudinal central axis 41 with sprocket or feed holes 42. Both the feed holes 42 and the pedestals 34 are centered on the axis 41 in a central zone 43 which extends the length of the tape 33. An outer or peripheral area 44, adjacent the zone 43 of the tape 33 between the pedestal 34 and an edge 46 is substantially of the same width on either side of the pedestals 34. In these peripheral areas 44, lugs 47 extend from the other major surface 48 of the tape 33. The lugs 47 are alternately spaced along opposite edges 46. Preferably they are formed by swaging the material of the tape 33 to form a wall 51 which extends perpendicular to the major surfaces of the tape.

It is important to note that the pedestals 34 on the tape 33 are formed to extend from the major surface 36 while the lugs 47 extend from the other major surface 48 of the tape. Referring to FIG. 4, a cross section of a portion of a sprocket wheel 56 is shown. The wheel 56 is similar to that disclosed in an application, Ser. No. 674,336 filed Apr. 7, 1976 in the name of E. Kovacs et al., which is assigned to the assignee of the present application. The referred-to application discloses an apparatus for aligning small articles such as semiconductor chips and for loading them onto predetermined sites of a prior art tape. If a sprocket wheel disclosed in the referred-to application is modified in accordance with the principles shown in and described in reference to FIG. 4, the tape 33 may be loaded with chips in accordance with the principles of the referred-to application.

In FIG. 4, a surface 58 carrying the tape 33 is limited in width to substantially that of the zone 43 wherein the pedestals 34 are located, and does not extend to the peripheral areas 43 of the tape. Circumferential recesses 59 on both the front face 61 and the rear flange 62 of the wheel 56 receive the lugs 47 as the tape 33 is wound onto and advanced by the wheel 56. The recesses 59 are, of course, chosen to provide sufficient clearance for the lugs 47 in both the lateral and vertical direction to permit the tape 33 to center on sprocket pins 64 of the wheel.

Figure 5:
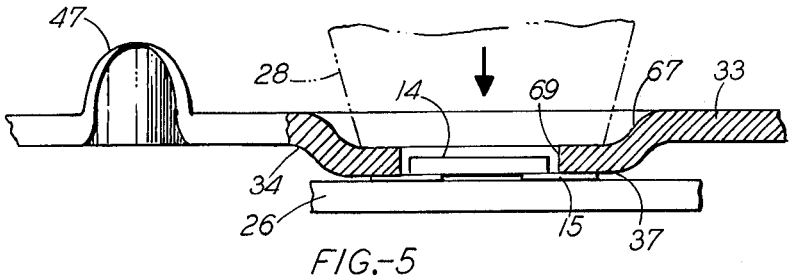
FIG. 5 is an enlarged partial section of the tape shown in FIG. 3.

Referring to FIG. 5 there is shown a portion of the tape 33 in section and positioned in relation to the bonding thermode 28 and to the substrate 26 to illustrate the differences of the tape 33 over the prior art tape of FIG. 2. Similar to the position of the thermode in FIG. 2, the thermode 28 in FIG. 5 is seated during the bonding operation in a recess 67 formed by the pedestal 34 extending from the other side of the tape. The lugs 47 are located on the same side of the tape as the thermode 28. However, the lugs 47 are laterally and longitudinally offset from the position of the recess 67 and do not interfere with the access of the thermode 28 to the recess 67.

In contrast to the bonding operation employed with respect to the prior art tape, the thermode 28 depicted in FIG. 5 does not push material of an embossment through the tape before a thermal compression bond is formed between the leads 15 and the substrate 26. To the contrary, as compressive energy is applied in the direction of the arrow, the energy is transmitted through the compliant material of the tape and applied directly to the beams 15 of the chip 11. The body of the chip 11 is protected from becoming damaged by the thermode 28 or the substrate through the compressive forces existing between them since it is securely located in the aperture 69 in the center of the pedestal 34.

Figure 6:
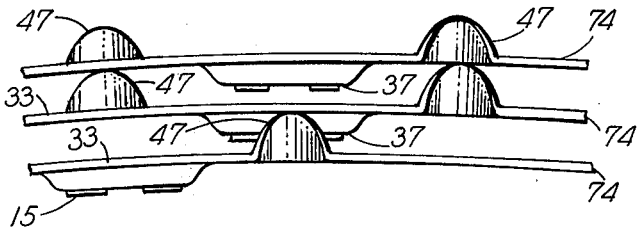
FIG. 6 shows several portions of the tape of FIG. 5 superpositioned on each other as they could be positioned when the tape is wound onto a reel.

The function of the lugs 47 to protect the beams 15 of the chips 11 is best explained in reference to FIG. 6 which shows three layers of the tape 33 in superposition as these layers would normally be arranged when the tape 33 wound onto a reel as, for instance, by the apparatus disclosed in the E. Kovacs et al. application. When the chips 11 are mounted on the tape 33, the beams 15 are located on the planar surface 37 about the aperture 69. Since the surface 37 represents the top of the pedestal 34, the beams 15 are apparently not protected when the tape 33 is wound onto a reel 72 a portion of which is shown in section in FIG. 7. However, as the tape 33 is wound onto the reel the lugs 47 space or separate each subsequent layer 74 wound onto the reel to protect the chips from contact with the portion of the tape from which the lugs are extending. The minimum height of the lugs is consequently critical. It is important that the height above the major surface 48 to which the lugs extend exceeds the height of the pedestals 34 plus the height to which the chips 11 extend above the planar surface 37 of the pedestals. With respect to the beam lead chips 11, the total height to which these chips extend above the planar surface 37 is the thickness of the beam leads 15. The total thickness of the body 14 of each of the chips is protected by the aperture 69 in the center in each of the pedestals.

Properly spacing the layers 74 of the tape and protecting the chips from the lugs 47 the location of the lugs in the peripheral area of the tape is of importance. Once the chips 11 are mounted on the tape 33, the tape is intended to be wound onto a reel 75, a portion of which is shown in an end view in FIG. 7. As it can be seen from FIG. 6, in winding the tape onto the reel 75, shifting of the position of the tape 33 in the longitudinal direction of the tape takes place among the various layers of the tape as they come to rest on top of each other on the reel 75. Consequently, a lug 47 may be positioned directly adjacent one of the pedestals of an overlying layer. Because of the position of such a lug in the peripheral area 43 of the tape, the lug is laterally displaced with respect to the pedestal of the above layer facing the lug. Consequently, the chip located on the pedestal will not be damaged by the lug.

Figure 7:
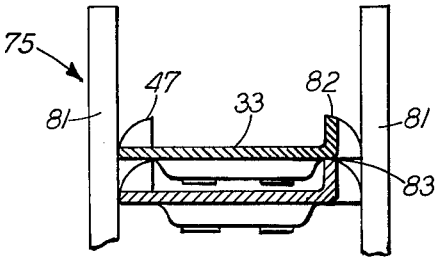
FIG. 7 shows a cross section through a reel with two layers of the tape superpositioned on top of each other.

Another advantage of the tape is best shown, again, in reference to FIGS. 6 and 7. The two top layers 74 of the layers of tape shown in superposition in FIG. 6 are shown in vertical alignment. As the tape is wound onto the reel periodically such an alignment does occur. A requirement of the lugs 47 consequently is that they do not nest, once they become aligned in superposition as shown in FIG. 6. The wall 51 of each of the lugs is formed up, perpendicular to the plane of the tape. In FIG. 7, two layers of the tape 33 are shown in coincident superposition on the reel. Flanges 81 of the reel 75 vertically align each subsequent layer on top of the preceding layer of tape as the tape is wound onto the reel. Consequently, an upper point 82 of the lug of the lower layer comes to rest against a base portion 83 of the lug in the upper layer. Lateral restraint of the layers of tape between the flanges 81 of the reel 75 prevents a lateral displacement of the various tape layers with respect to each other. Consequently, the two vertically aligned lugs on the two adjacent layers of tape wound onto the reel cannot seat into each other thereby damaging the beams 15 of the chip 11 mounted to the pedestal shown in the upper layer. Of course, if a slight amount of nesting took place, the features extending from the pedestal in the upper layer would begin to nest in the recess 67 formed by the pedestal in the lower layer so that even in case of a small amount of nesting the chip 11 mounted to a respective one of the pedestals 47 remains protected.

While the invention has been described with respect to handling beam-lead chips such as beam-lead integrated circuits, it should be understood that various modifications and changes can be made to the specific embodiment described without departing from the spirit and scope of the invention. For example, in the described embodiment, the beam leads are mounted onto the planar surface 37 thus becoming exposed to direct contact with the substrate 26 during the bonding operation. While in the described embodiment the chip itself remains protected in the aperture of the pedestal, it is conceivable that for other chips, such as beamless chips, which may be bonded by other than thermocompression bonding, the entire chip may be mounted on top of a pedestal such as the pedestal 34. And, then, again, the height of the pedestal may be varied, or may be even eliminated altogether. However, in making such changes it should be kept in mind that the total height of the lugs extending from the surface opposite that to which the articles are mounted, exceeds the total height of any pedestal plus the thickness or height of that portion of the articles extending beyond the surface 37 of the pedestals. Therefore, it must be realized, that other changes and modifications can be made within the scope and spirit of this invention. The invention is to be limited only by the scope of the appended claims.

What is claimed is:

1. A tape for retaining electronic articles which comprises a longitudinal zone located in symmetry with a longitudinal centerline on one major surface of the tape;

periodically recurring embossments located along the centerline within the longitudinal zone and extending above the one major surface of the tape, each embossment forming a pedestal for mounting one of the articles, each pedestal having a central aperture of a shape similar to the planar extent of a body of the article to be mounted to the pedestal, the walls of the aperture having rounded corners at the junction with a planar mounting surface of the pedestal, the mounting surface capable of supporting extensions from the body to position the body of the article with at least the extensions of such articles extending above the surface of the pedestal, such planar mounting surface being capable of applying uniform pressure against the extensions during a transfer of the article to a substrate; and lugs extending from the other major surface of the tape with walls formed perpendicular to such surface in areas laterally offset from the zone and alternately on one peripheral edge of the tape and then on the other in a pattern the spacing of which is equal to that of the pedestals in positions longitudinally offset from the positions of the pedestals, the lugs having a predetermined height above said other major surface of the tape, said height being greater than that of the portion of each such article above said one major surface of the tape, whereby an overlying layer of the tape is held out of contact with the extending portion of the articles mounted to the pedestals.

* * * * *